US009347382B2

(12) United States Patent
Machida et al.

(10) Patent No.: US 9,347,382 B2
(45) Date of Patent: May 24, 2016

(54) MULTIPLE THROTTLE DEVICE

(71) Applicant: MIKUNI CORPORATION, Tokyo (JP)

(72) Inventors: Toshinobu Machida, Odawara (JP); Hiroyuki Shinohara, Odawara (JP)

(73) Assignee: MIKUNI CORPORATION, Tokyo (JP)

( * ) Notice: Subject to any disclaimer, the term of this patent is extended or adjusted under 35 U.S.C. 154(b) by 277 days.

(21) Appl. No.: 13/689,486

(22) Filed: Nov. 29, 2012

(65) Prior Publication Data

US 2013/0133617 A1 May 30, 2013

(30) Foreign Application Priority Data

Nov. 30, 2011 (JP) ..... 2011-262027

(51) Int. Cl.
*F02D 9/10* (2006.01)

(52) U.S. Cl.
CPC ..... *F02D 9/109* (2013.01); *F02D 9/105* (2013.01); *F02D 9/1065* (2013.01); *F02D 9/1095* (2013.01)

(58) Field of Classification Search
CPC F02D 9/105; F02D 9/1095; F02D 2009/0294
USPC ..... 123/336
See application file for complete search history.

(56) References Cited

U.S. PATENT DOCUMENTS

| | | | | |
|---|---|---|---|---|
| 7,152,581 | B2 * | 12/2006 | Wayama et al. | 123/399 |
| 8,113,168 | B2 * | 2/2012 | Yamada | 123/336 |
| 2007/0068490 | A1 * | 3/2007 | Matsuda | 123/396 |
| 2009/0241900 | A1 | 10/2009 | Sato et al. | |
| 2010/0095930 | A1 * | 4/2010 | Wong | 123/336 |
| 2010/0132663 | A1 * | 6/2010 | Hamasaki et al. | 123/336 |
| 2012/0304965 | A1 * | 12/2012 | Uchiyama et al. | 123/399 |
| 2014/0032077 | A1 * | 1/2014 | Sasaki | 701/93 |

FOREIGN PATENT DOCUMENTS

| | | | |
|---|---|---|---|
| DE | 19540323 | | 4/1997 |
| DE | 10 2008 063 210 | | 1/2009 |
| EP | 1462644 | | 9/2004 |
| EP | 2143914 | A1 | 1/2010 |
| JP | 2-45624 | | 2/1990 |
| JP | 2003-269196 | A | 9/2003 |
| JP | 2004-132289 | | 4/2004 |
| JP | 2004-293437 | A | 10/2004 |
| JP | 2005-113748 | A | 4/2005 |
| JP | 2007-064068 | A | 3/2007 |

OTHER PUBLICATIONS

Extended European Search Report for EP 12195022.4, dated May 19, 2015.

* cited by examiner

*Primary Examiner* — Thomas Moulis
(74) *Attorney, Agent, or Firm* — Marshall, Gerstein & Borun LLP

(57) ABSTRACT

A multiple throttle device of the invention employs a constitution in which, as a sensor section that detects the opening of throttle valves, a shaft member formed to have a different axis from a throttle shaft is positioned within the width L of a throttle body, and a throttle position sensor is disposed in the shaft member.

4 Claims, 8 Drawing Sheets

MULTIPLE THROTTLE DEVICE

BACKGROUND OF THE INVENTION

1. Field of the Invention

The present invention relates to a multiple throttle device that is mounted on an engine having a plurality of cylinders.

2. Description of the Related Art

Motorcycles (vehicles) are equipped with an engine in which a plurality of cylinders are arranged in line for high power. In many engines for motorcycles, cylinders are arranged in a vehicle width direction to be compactly housed in space (engine room) under a fuel tank.

Such an engine for a motorcycle has a structure in which a multiple throttle device is mounted on each cylinder of the engine, or more specifically, on an intake port of each cylinder in order to secure responsiveness.

The multiple throttle device is a device in which one throttle valve is allocated to each of the intake ports, and the throttle valves are opened and closed in synchronization. This multiple throttle device has a structure in which intake passages leading to the intake ports of the engine are formed in a throttle body fixed to the engine; the throttle valves are allocated to the respective intake passages; and the throttle valves are supported by a long throttle shaft disposed in a juxtaposed direction of the valves. The throttle valves are simultaneously opened/closed by displacement of the throttle shaft.

More and more motorcycles are equipped with a throttle-by-wire multiple throttle device as with four-wheel vehicles. In the throttle-by-wire multiple throttle device, the throttle shaft is driven by a drive section including a motor and a gear mechanism for transmitting the power of the motor, and the opening of the throttle valves is detected by a sensor section made up of a throttle position sensor. This way, the multiple throttle device is capable of controlling the opening degree of the throttle valves according to a target opening degree.

The throttle position sensor is an important component in terms of controlling the throttle valves.

As disclosed in Unexamined Japanese Patent Publication No. 2004-132289, in a number of multiple throttle devices, the throttle position sensor is disposed in an end face of the throttle shaft that is inserted through the throttle body along the entire width (in the direction where the intake passages are arranged and along the entire length).

The throttle position sensor of this type is fixed to the end of the throttle shaft and thus placed in the outermost position of the throttle body. This allows the throttle position sensor to outwardly protrude from the end portion of the throttle body in the width direction as shown in Patent Document 1.

However, many of the motorcycles equipped with an engine in which cylinders are arranged in line include a cylinder line extending in the vehicle width direction in consideration of equipment capacity. The throttle position sensor is placed in the outermost position in the vehicle width direction according to the equipment of the engine.

The throttle position sensor practically increases the entire width of the throttle body, so that the throttle body is prone to contact the frame members disposed on both sides of the engine.

Also, if the motorcycle (vehicle) falls down, the throttle position sensor is likely to be damaged by hitting against the ground or the like.

One way of solving this problem is to set the throttle position sensor in the drive section for driving the throttle shaft, for example, a gear for transmitting a drive force from the motor to the throttle shaft. On the other hand, if the foregoing structure is employed, a conventional method for detecting the shaft displacement has to be utterly changed to a method for detecting the displacement of a special gear, so that the sensor section needs to have a special structure, resulting in a considerable cost increase. On this account, it is difficult to employ the above-mentioned structure.

SUMMARY OF THE INVENTION

It is an object of the invention to provide a multiple throttle device in which a throttle position sensor is provided to prevent an increase in entire width of a throttle body and prevent the risk of damage on a vehicle when the vehicle falls down while following a conventional method for detecting the opening of a throttle valve from shaft displacement.

In order to accomplish the object, a multiple throttle device of the present invention employs a constitution in which, a shaft member, which is formed to have a different axis from a throttle shaft and displaced with the throttle shaft, is positioned within the width of a throttle body, and as a sensor section for detecting the opening of a throttle valve, a throttle position sensor that detects the opening of the throttle valve from displacement of the shaft member is fixed to the shaft member.

According to the invention, since the throttle position sensor is positioned within the width of the throttle body, the throttle position sensor is less likely to hit against the ground or the like when the motorcycle (vehicle) falls down. Moreover, the throttle body is prevented from being increased in entire width, so that the throttle body is unlikely to contact the frame members disposed on both sides of the engine. This enhances the equipment capacity of the engine. In addition, since the opening of the throttle valve is detected by the displacement of the shaft member, the conventional detection method can be used, and the structure does not cost much.

It is then possible to provide a multiple throttle device that prevents the increase of entire width of the throttle body and the risk of damage on the throttle position sensor in the event of the fall of the vehicle, and at the same time, follows the conventional method for detecting the throttle valve.

BRIEF DESCRIPTION OF THE DRAWINGS

The present invention will become more fully understood from the detailed description given hereinafter and the accompanying drawings which are given by way of illustration only, and thus, are not limitative of the present invention, and wherein.

DETAILED DESCRIPTION OF THE INVENTION

The present invention will be described below with reference to one embodiment shown in FIGS. 1 to 9.

Figure 1:
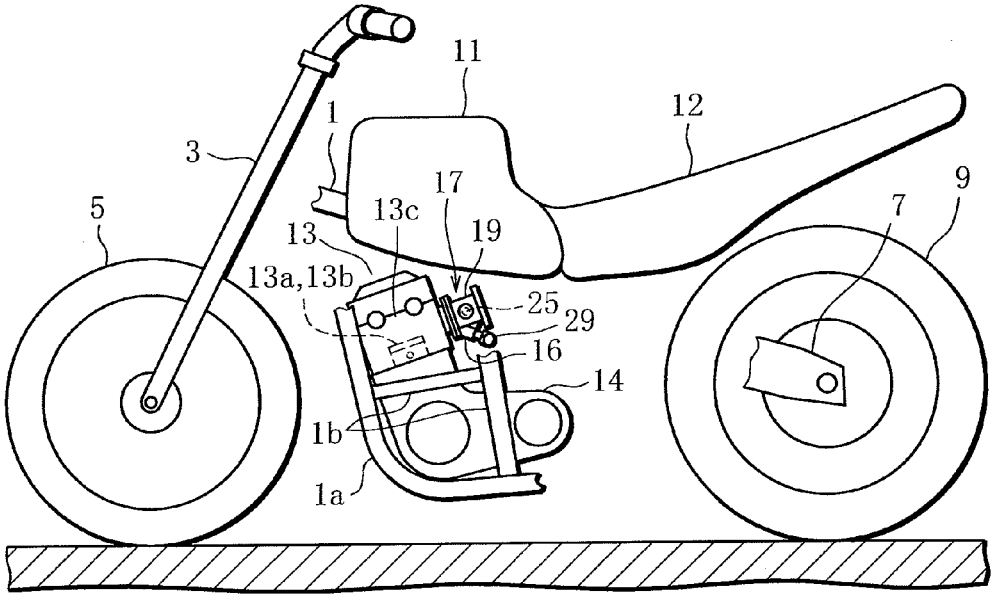
FIG. 1 is a side view of a motorcycle equipped with a multiple throttle device according to one embodiment of the invention.
Figure 2:
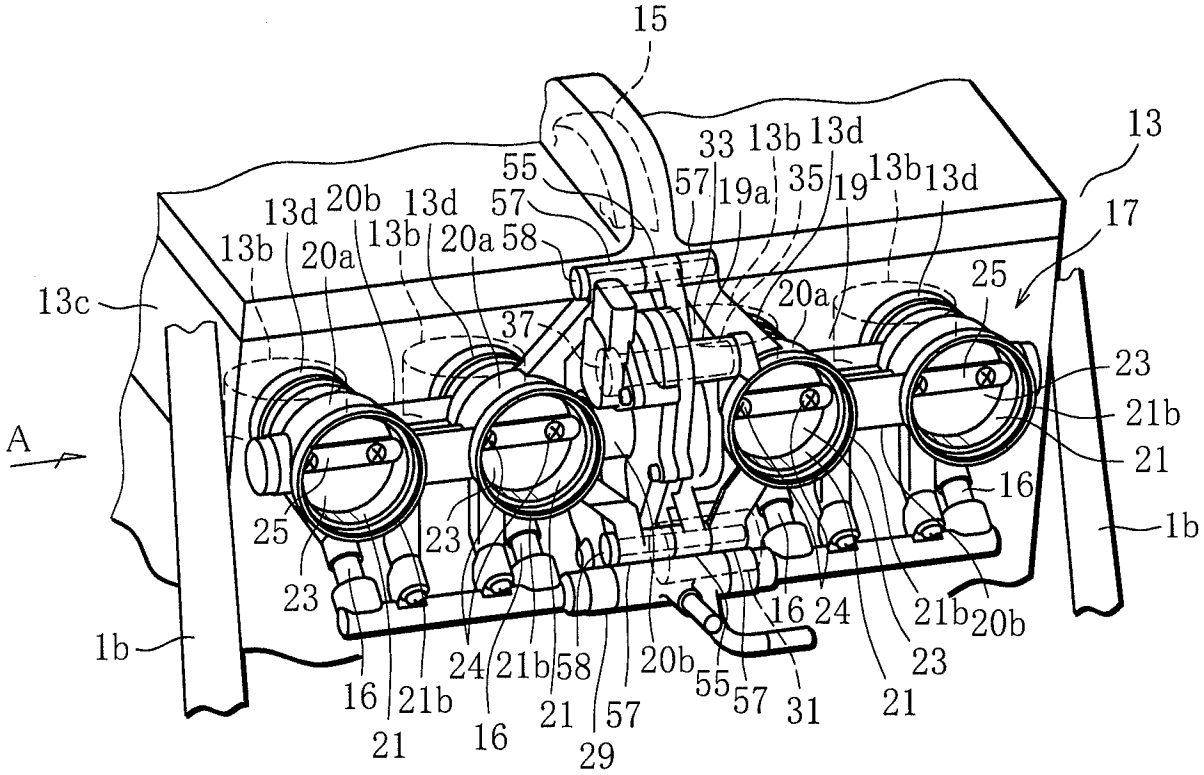
FIG. 2 is a perspective view showing the multiple throttle device with an engine in an enlarged scale.
Figure 3:
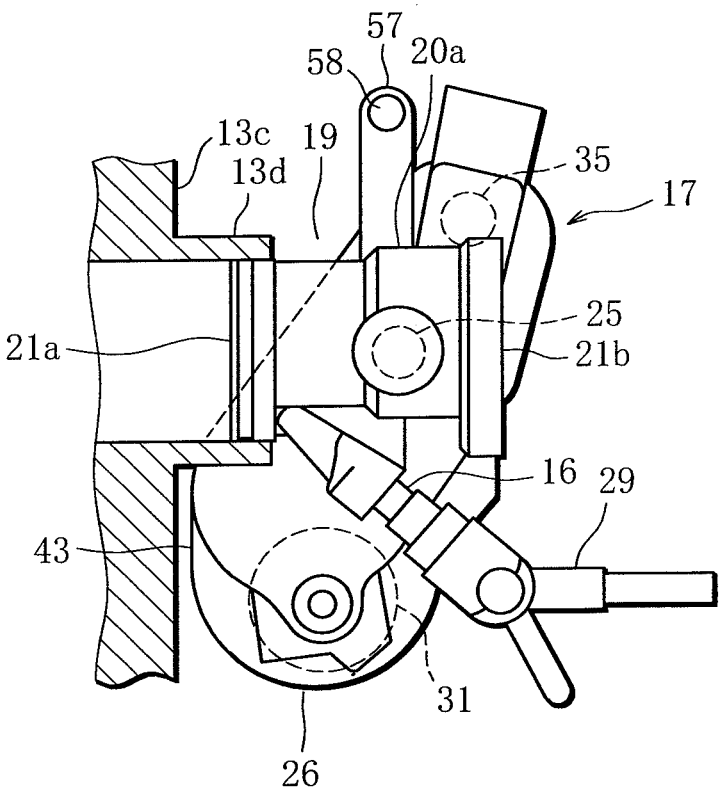
FIG. 3 is a side view of the multiple throttle device as viewed in a direction of an arrow A in FIG. 2.

FIG. 1 schematically shows a motorcycle (vehicle) equipped with a multiple throttle device of the present invention. FIG. 2 shows the multiple throttle device in an enlarged scale. FIG. 3 shows a side face (as viewed in a direction of an arrow A in FIG. 2) of the multiple throttle device. An arrow F in FIG. 1 shows a front direction of the motorcycle, and an arrow R a rear direction of the motorcycle.

Referring to the parts of the motorcycle, the motorcycle has a body including a main frame, for example, a main tube 1 (only partially shown in the figure), which extends in an anteroposterior direction. A front wheel 5 is fixed to a front end portion of the main tube 1 through a front fork 3. Similarly, a rear wheel 9 is fixed to a rear end portion of the main tube 1 through a swing arm member 7.

Attached to the main tube 1 are a fuel tank 11 and a seat 12 in the order from front to back. On one side (right side) of the body across the main tube 1, there is provided an acceleration/deceleration system, not shown, including a brake pedal, a throttle grip, etc. In an opposite side (left side), a transmission system, not shown, including a clutch lever, a shift pedal and the like, is provided.

Various tubes 1*a* and 1*b* extend from the main tube 1 to surround space under the fuel tank 11, and thus form an engine room in the space under the fuel tank 11. In the engine room, a reciprocating engine 13, in which a piston 13*a* is reciprocatably housed, is situated with a transmission 14.

As shown in FIG. 2, the engine 13 is an engine with a plurality of cylinders 13*b*, for example, an in-line four-cylinder engine in which four cylinders 13*b* are arranged in line at predetermined intervals. The engine 13 is an engine for a motorcycle, in which a timing gear 15 is situated in the center of a cylinder head 13*c* in the width direction, or more specifically, between the second and third cylinders. Span between the second and third cylinders located in the center of the engine is set wider than that between the other cylinders. The engine 13 is placed sideways, that is, in a position where the cylinders 13*b* (cylinder line) are arranged in the vehicle width direction. The engine 13 is inclined in an anterior direction.

As shown in FIGS. 2 and 3, the multiple throttle device, or a throttle-by-wire four throttle device 17 with an injector 16 in this specification, is fixed to an intake side of the engine 13, for example, cylindrical intake ports 13*d* protruding from the cylinder head 13*c* in the same arrangement as with the cylinders 13*b* (in line). An air cleaner, not shown, is fixed to the intake side of the four throttle device 17.

Figure 4:
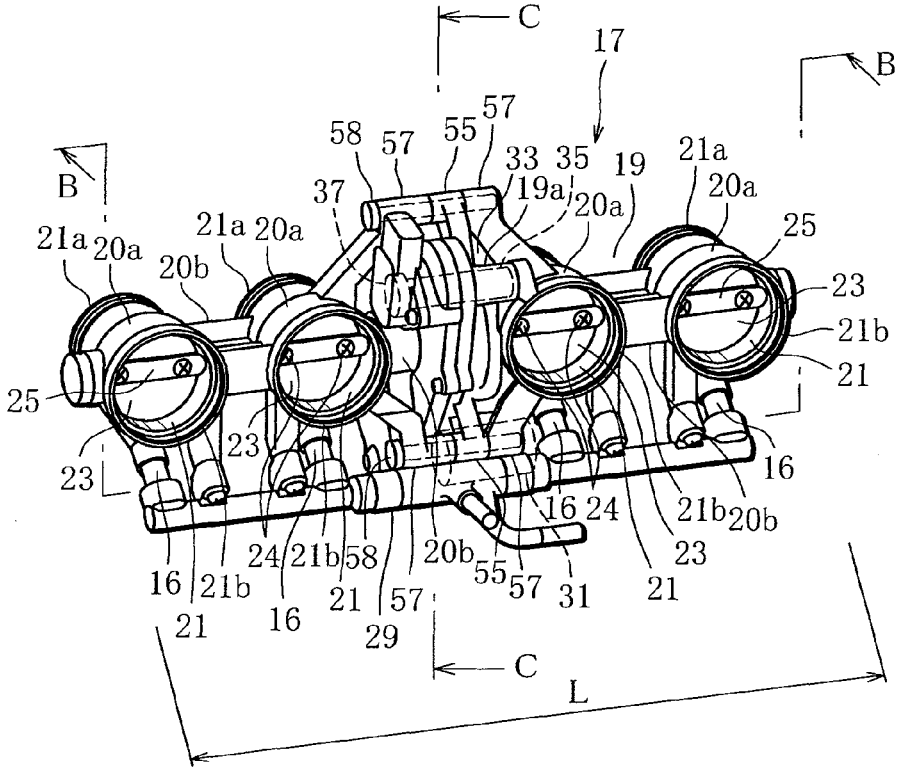
FIG. 4 is a perspective view showing the entire multiple throttle device (including an injector).
Figure 5:
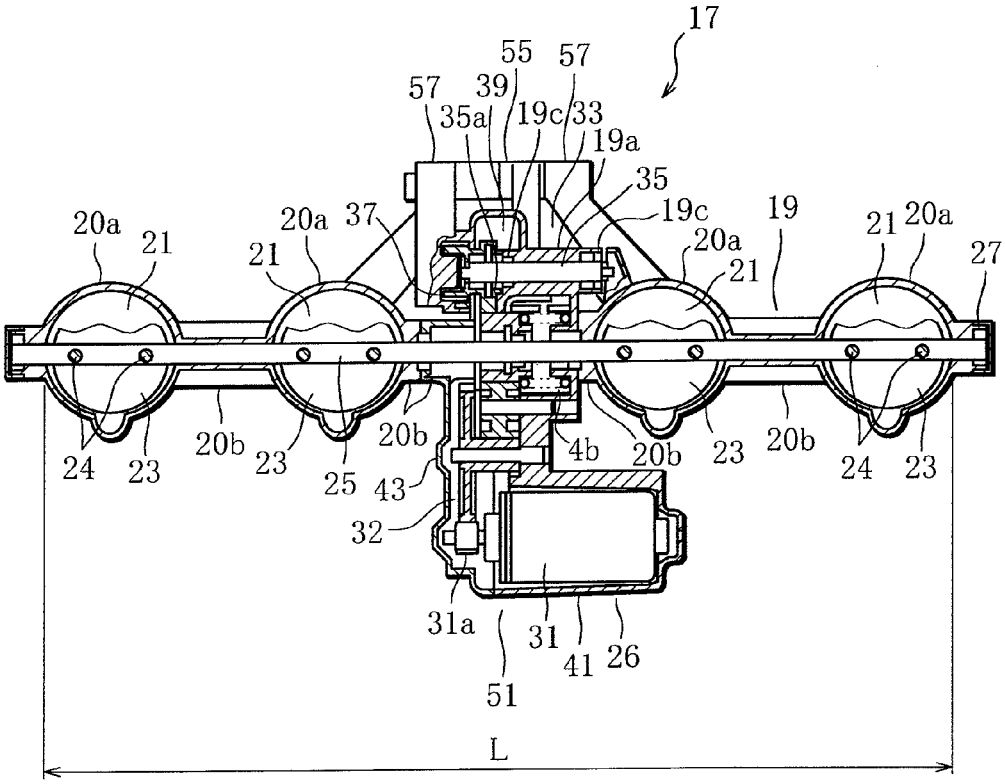
FIG. 5 is a sectional plan view of the multiple throttle device, taken along line B-B in FIG. 4.
Figure 6:
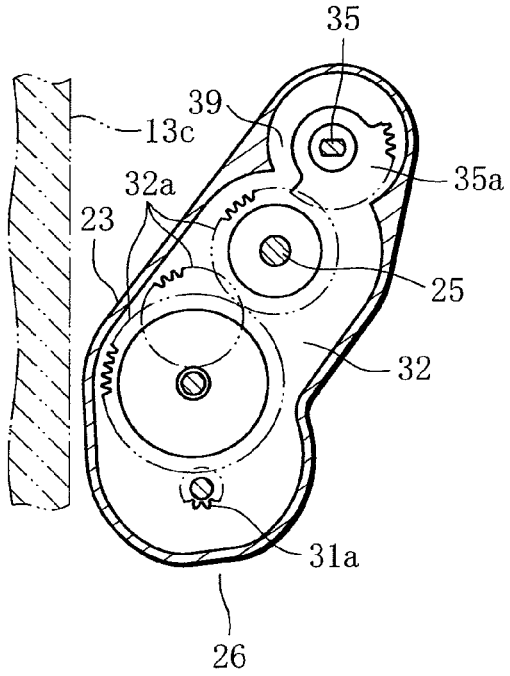
FIG. 6 is a sectional side view of the multiple throttle device, taken along line C-C in FIG. 4.

FIG. 4 shows the appearance of the four throttle device 17. FIG. 5 is a sectional plan view of the entire four throttle device 17 (taken along line B-B in FIG. 4). FIG. 6 is a sectional side view showing a central portion of the four throttle device 17 (taken along line C-C in FIG. 4).

The four throttle device 17 will be described with reference to FIGS. 4 and 5. In these figures, reference numeral 19 represents a throttle body. The throttle body 19 includes four drums 20*a* in a shape of a short cylinder, which are arranged in line corresponding to the arrangement of the intake ports 13*d*. The drums 20*a* are connected to each other with a connecting portion 20*b*, thus forming the entire throttle body combined with the intake ports 13*d*.

More specifically, the drums 20*a* have a cylindrical shape corresponding to the shape of the intake ports 13*d* of the engine 13. Intake passages 21 are formed inside the drums 20*a*. One end portion of each of the drums 20*a* serves as a lead-out portion 21*a*, and the other end portion a lead-in portion 21*b*. The lead-out portions 21*a* are connected to the intake ports 13*d* of the engine 13, and the lead-in portions 21*b* to the air cleaner, not shown.

The drum 20*a* accommodates a throttle valve 23 formed, for example, into a disc-like valve element. A long throttle shaft 25 is rotatably inserted into the throttle body 19 along the entire length (entire length in the width direction) in the direction where the throttle valves 23 are arranged. Needless to say, the throttle shaft 25 is rotatably supported at portions, namely, both end portions in this specification, by using bearings provided in the end portions of the throttle body (FIG. 5).

The throttle shaft 25 is inserted through the drums 20*a*. Central portions of the throttle valves 23 are detachably fixed to the throttle shaft passing through the drums 20*a* (with screw members 24, for example). When the throttle shaft 25 is turned, the four throttle valves 23 corresponding to the cylinders 13*b* are simultaneously turned and displaced. This way, an intake amount is changed. An injector 16 and a fuel pipe 29 are situated downstream of the drums 20*a* across the throttle valves 23.

The throttle body 19 is provided with a drive section 26 for driving the throttle shaft 25 as shown in FIGS. 4 to 6. For example, the drive section 26 has a structure in which a motor section 31 serving as a drive source is combined with a deceleration gear mechanism 32 that is a transmitting section for decelerating and transmitting the output rotation of the motor section 31 to the throttle shaft 25. In short, the throttle body 19 is driven by the drive force outputted from the motor section 31.

The throttle body 19 is further provided with a sensor section 33 that detects the opening of the throttle valves 23 as shown in FIGS. 4 to 6. The sensor section 33 is situated not in the end portion of the throttle body but within an area where the intake passages 21 are arranged as shown in FIG. 4, that is, within width L of the throttle body 19 (corresponding to the width of the invention). Moreover, in order not to increase the cost, the sensor structure following a conventional detection method is used.

The sensor section 33 will be described below. As shown in FIG. 5, the sensor section 33 has a shaft member, for example, a sensor shaft 35, which is formed to have a different axis from the throttle shaft 25, and a throttle position sensor 37 (hereinafter, referred to as TPS 37) that detects the opening of the throttle valves 23 from displacement of the sensor shaft 35. The sensor section 33 further has a transmission mechanism, or a gear mechanism 39 in this specification, which transmits the turning displacement of the throttle shaft 25 to the sensor shaft 35. This way, the sensor shaft 35 is turned and displaced together with the throttle shaft 25.

As shown in FIG. 5, the sensor shaft 35 is made up of a short shaft member. The TPS 37 is made up of a sensor component arranged in one end face of the short shaft member. In other words, the sensor section 33 has a structure following a conventional method that conducts the detection on the basis of shaft displacement.

The sensor shaft 35 is situated in a place located within the width L of the throttle body 19, for example, a place close to the center of the throttle body 19, or more specifically, a place between the intake passages located close to the center.

The sensor section 33 is situated in space between the drums 20*a* (between predetermined intake passages) corresponding to space between the second and third cylinders of the engine 13, which is wider than that between the other cylinders. To be more specific, as shown in FIG. 5, a sensor housing section 19*a* is formed in a portion of the throttle body, which is located between the drums 20*a* corresponding to between the second and third cylinders. The sensor shaft 35 and the TPS 37 are housed in the sensor housing section 19*a*.

In addition, the sensor shaft 35 is completely disposed parallel with the throttle shaft 25 by being inserted into a shaft hole formed in the sensor housing section 19*a*. Both end portions of the sensor shaft 35 are rotatably supported by bearing portions 19*c* disposed on both end sides of the shaft holes. The entire sensor shaft 35 is provided to have a different axis from the throttle shaft 25. The TPS 37 is situated in an end face of the sensor shaft 35, so that the opening of the throttle valve 23 can be detected by the sensor shaft 35 that is turned and displaced with the throttle shaft 25.

Due to the foregoing structure, the sensor section 33 is compactly placed in the center of the throttle body 25 in the width direction by using the characteristics of the engine 13 of the motorcycle, that is, the characteristics that the space between the second and third cylinders is wider than that between the other cylinders.

Not only the sensor section 33 but also the motor section 31 and the deceleration gear mechanism 31 (both forming the drive section), which are heavy in weight, are placed close to the center of the throttle body 19 in the width direction. The motor section 31 and the deceleration gear mechanism 32 are situated between the drum 20*a* of the second cylinder and the drum 20*a* of the third cylinder located in the center of the throttle body 19 in the width direction corresponding to the center of the engine 13 in a longitudinal direction so as to be compactly placed in the throttle body 19. The gear mechanism 39 is also situated between these drums 20*a* so that separate instruments are converged on the center of the throttle body 19 in the width direction (the center of the engine 13 in the longitudinal direction).

Especially, the instruments are positioned effectively using the space between the drum 20*a* of the second cylinder and the drum 20*a* of the third cylinder (between the predetermined intake passages). As shown in FIGS. 4 to 6, the sensor section 33 is positioned on the upper side (one side) in a radial direction of the intake passages 21 across the throttle shaft 25 in the space between the drum 20*a* of the second cylinder and the drum 20*a* of the third cylinder, and the drive section 26 is positioned on the lower side in the radial direction on the opposite side (the other side).

More specifically, as shown in FIGS. 4 to 6, the sensor housing section 19*a* housing the sensor shaft 35 and the TPS 37 is formed in an upper portion of the throttle body across the throttle shaft 25, and a motor case 41 housing the motor section 31 is formed in a lower portion of the throttle body, which is located on the opposite side to the upper portion. A gear case 43 housing the deceleration gear mechanism 32 and the gear mechanism 39 is formed between the sensor housing section 19*a* and the motor case 41. The drive section 26, the sensor section 33 and the gear mechanism 39 are thus placed (converged) to occupy the entire space between the drum 20*a* of the second cylinder and the drum 20*a* of the third cylinder.

As shown in FIG. 6, distance from a pinion gear 31*a* to a sensing gear 35*a* on the sensor shaft 35 is set as short as possible. The motor section 31 and the gears, which are heavy in weight, are located as close as possible to the cylinder head 13*c*. As a result, there is a good weight balance.

Due to the foregoing structure, the output of the motor section 31 is transmitted from the pinion gear 31*a* of an output shaft of the motor section 31 through a plurality of deceleration gears 32*a* engaged with the pinion gear 31*a* to the throttle shaft 25. At the same time, the output of the motor section 31 is transmitted from the deceleration gear 32*a* on the throttle shaft 25 to the sensing gear 35*a* fixed to the sensor shaft 35. The opening of the throttle valves 23 is then detected by the TPS 37 located in the end portion of the sensor shaft 35. According to this detection signal, the throttle valves 23 are lead to target opening.

Restoring spring members 46 for restoring the throttle valves 23 are combined with the deceleration gear 32*a* on the throttle shaft 25 (FIG. 5).

The four throttle device 17 has a structure in which each component can be taken apart so that the four throttle device 17 suitable for the engine 13 of various kinds can be obtained while maintaining the above-described characteristics.

Figure 7:
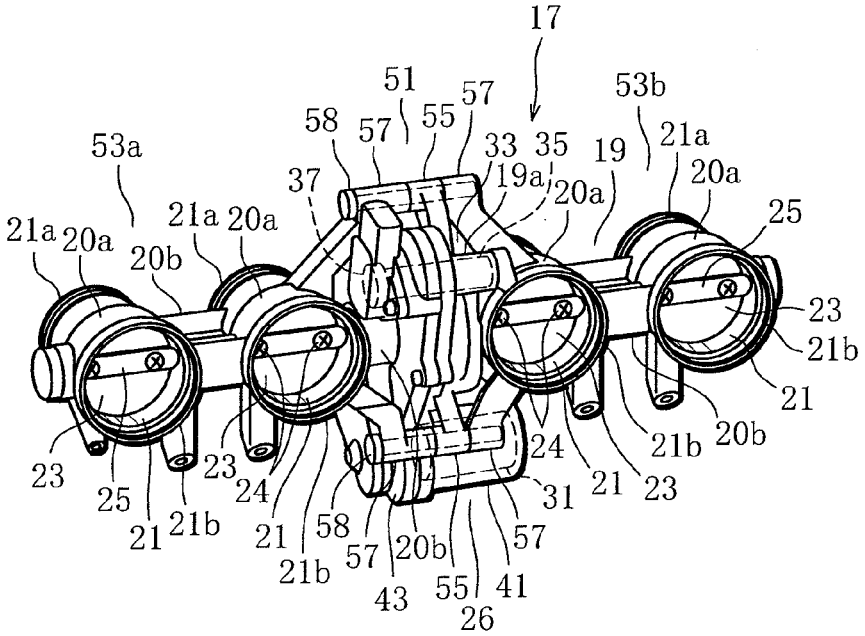
FIG. 7 is a perspective view of the multiple throttle device, from which the injector is removed.
Figure 8:
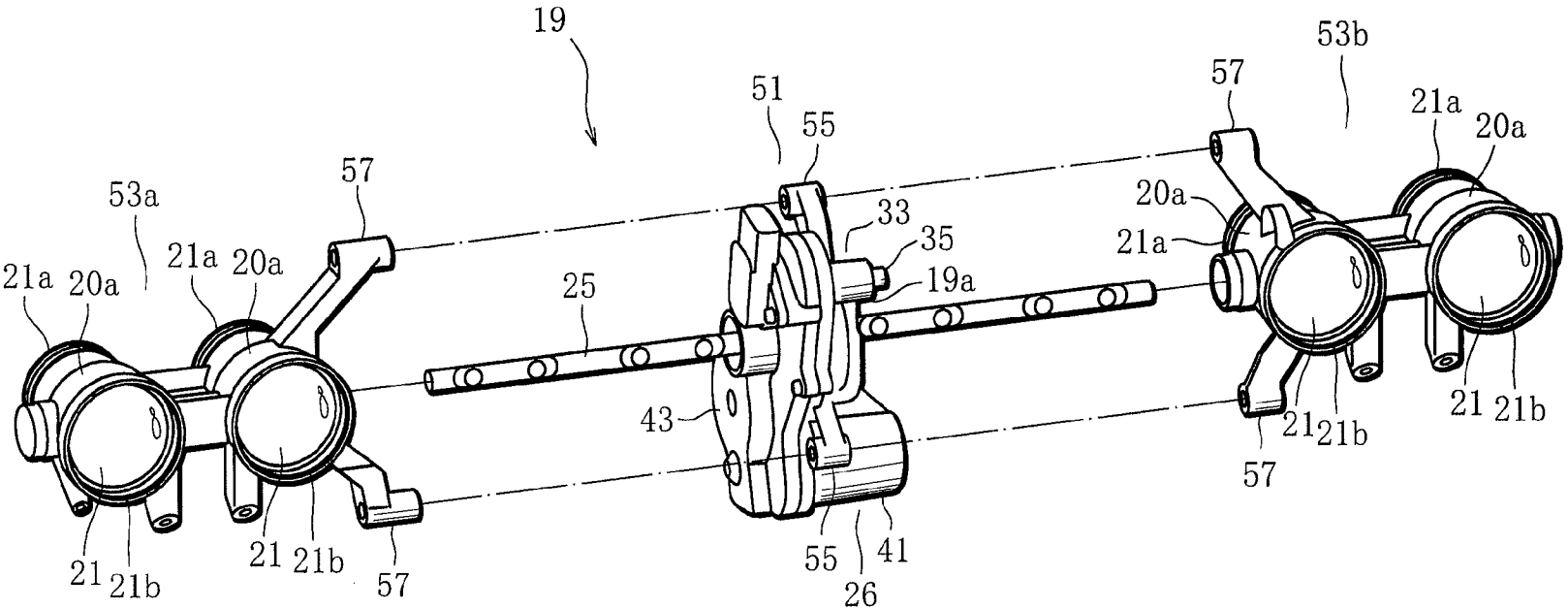
FIG. 8 is a perspective view of the multiple throttle device divided into an auxiliary machine unit, a first throttle body and a second throttle body.
Figure 9:
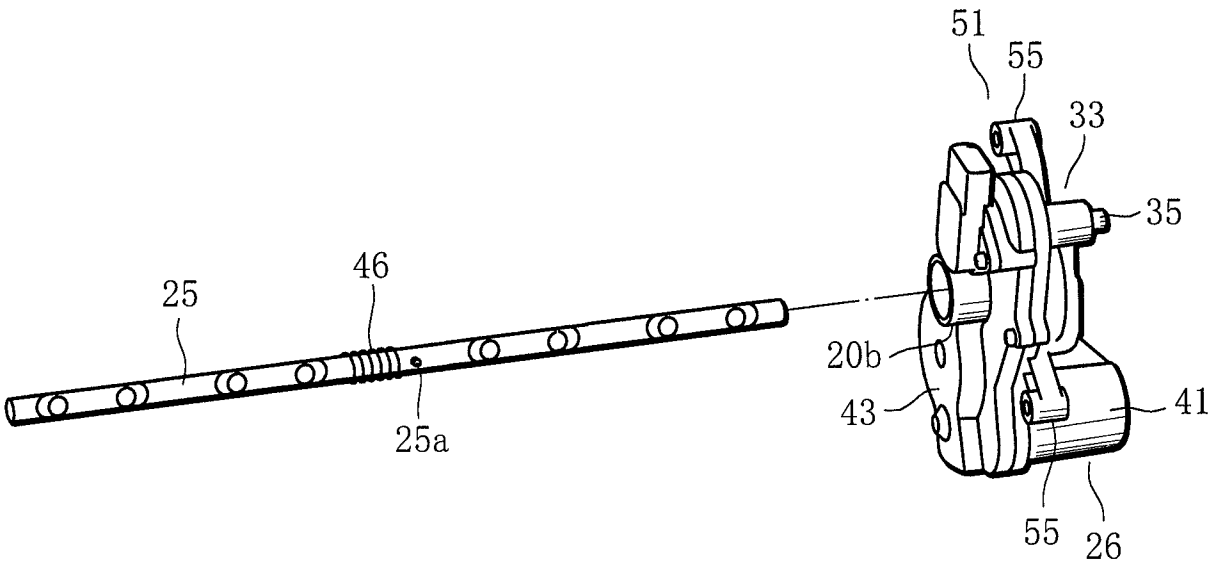
FIG. 9 is a perspective view of the auxiliary machine unit, from which a throttle shaft is removed.

In the foregoing structure, as shown in FIGS. 7 to 9, a portion of the throttle body, which occupies a space between the drum 20*a* of the second cylinder and the drum 20*a* of the third cylinder, is converged with the drive section 26 (motor section 31 and deceleration gear mechanism 32) and the sensor section 35 (sensor shaft 35, TPS 37 and gear mechanism 39) to serve as one auxiliary machine unit 51 (corresponding to the unit of the invention). A portion of the throttle body, other than the portion between these drums 20*a*, namely, the drums 20*a* of the first and second cylinders (including the connecting portion 20*b*) and the drums 20*a* of the third and fourth cylinders (including the connecting portion 20*b*) are formed as first and second throttle bodies 53*a* and 53*b* (corresponding to the components detachably fixed to the auxiliary machine unit) separated from the auxiliary machine unit 51.

The auxiliary machine unit 51 is detachably combined with the first and second throttle bodies 53*a* and 53*b* by using a connecting portion, for example, a connecting structure in which a pair of receiving arms 55 protruding upwards and downwards from the auxiliary machine unit 51 and a pair of connecting arms 57 protruding upwards and downwards from the drums 20*a* (second and third cylinders) located on the end portions of the first and second throttle bodies 53*a* and 53*b* (FIGS. 4 and 7) are fastened together with bolt members 58. The multiple throttle device 17 of various kinds can be therefore assembled according to the engine 13.

In the present embodiment, the throttle shaft 25 is also designed to be detachable from the auxiliary machine unit 51. To achieve such a structure, the throttle shaft 25 has a protruding portion 25*a* in the axial center thereof as shown in FIG. 9. An inner surface of the shaft hole of the deceleration gear 32*a* on the throttle shaft 25 has a groove, not shown, extending in the axial direction. Due to the insertion of the throttle shaft 25, if the protruding portion 25*a* is simply set in the groove, drive force is transmitted from the throttle shaft 25 through the protruding portion 25*a* and the groove to the deceleration gear 32*a*.

Since the sensor shaft 35 and the TPS 37 are positioned within the width of the throttle body 19 as mentioned, even if the motorcycle (vehicle) falls down, the throttle-by-wire four throttle device 17 hits against the ground only at the end portion of the throttle body 19, and the sensor shaft 35 and the TPS 37 are unlikely to hit against the ground. Moreover, the entire width of the throttle body 19 is prevented from being increased since the sensor shaft 35 and the TPS 37 are positioned within the width of the throttle body 19. The throttle body 19 is then unlikely to contact the tubes 1*b* (frame members) arranged in both sides of the engine 13. The engine 13 is accordingly enhanced in equipment capacity. The structure that detects the opening of the throttle valves 23 from the displacement of the sensor shaft 35 (shaft member) follows the conventional detecting method that has been employed in conventional multiple throttle devices. Consequently, existing components can be used, and the cost is maintained low, as compared with an exclusive detecting structure that requires high cost.

It is therefore possible to prevent the increase of entire width of the throttle body 19 and the risk of damage on the TPS 37 when the vehicle falls down while following the conventional method for detecting the throttle valve 23. Consequently, the four throttle device 17 (multiple throttle device) that is inexpensive and has high equipment capacity and reliability can be provided.

Since the sensor section 33 is formed of the sensor shaft 35 made up of the short shaft member and the TPS 37 placed in the end face of the sensor shaft 35, it is possible to follow the conventional detection method with a simple and inexpensive structure.

Furthermore, the sensor shaft 35, the TPS 37 and the drive section 26 are placed close to the center of the throttle body 19 in the direction where the drums 20*a* are arranged, so that the weights of these instruments are converged in the center of the throttle body 19 in the width direction. This way, the weight balance of the engine 13 is enhanced, and the locomotion performance of the motorcycle (vehicle) is also improved. In particular, if the sensor shaft 35, the TPS 37 and the drive section 26 are placed between the drums 20*a* located in the center of the throttle body 19 in the width direction, the instruments are converged on the center of the engine 13 in the width direction by utilizing dead space. In other words, the instruments are made compact and moreover converged while enhancing the gravity balance of the engine 13. If the gear mechanism 39 for transmitting the displacement of the throttle shaft 25 to the sensor shaft 35 is added, compactification is further progressed, and the weight balance of the engine 13 is effectively secured.

When the sensor shaft 35, the TPS 37 and the drive section 26 are placed in the center of the throttle body 19 in the width direction, if the sensor shaft 35 and the TPS 37 are arranged on one side across the throttle shaft 25, and the drive section 26 on the other side, the sensor shaft 35, the TPS 37 and the drive section 26 are compactly converged by fully and effectively using space between the drums 20*a* located in the center. Especially, in the case of the motorcycle engine (four-cylinder) in which the timing gear 15 is placed in the center of the cylinder head 13*c*, and the span between the second and third cylinders located in the center of the engine 13 is wider than that between other cylinders, the sensor shaft 35, the TPS 37 and the drive section 26 can be compactly converged on the center of the throttle body 19 in the width direction using the wide span.

The sensor shaft 25, the TPS 37 and the drive section 26 are unitized with a portion occupying the center of the throttle body 19 in the width direction, or the space between the drums 20*a* of the second and third cylinders in this specification, thereby being formed into the auxiliary machine unit 51 (corresponding to the unit of the invention). The portions of the throttle body other than the portion between these drums 20*a*, or the portions between the drums 20*a* of the first and second cylinders or the drums 20*a* of the third and fourth cylinders in this specification, serve as the first and second throttle bodies 53*a* and 53*b* detachably fixed to the auxiliary machine unit 51. This makes it possible to obtain a multiple throttle device, or the four throttle device 17 in this specification, which is suitable for the engine 13 of various kinds while maintaining the above-mentioned characteristics.

FIGS. 7 to 9 show a process of assembling the four throttle device 17. Referring to the process, in order to assemble the four throttle device 17, the throttle shaft 25 is first inserted into the auxiliary machine unit 51 that is beforehand combined with the sensor section 33, the drive section 26 and the gear mechanism 39 (transmission mechanism) as shown in FIG. 9. The throttle shaft 25 and the deceleration gear 32*a* are connected to each other by inserting the throttle shaft 25, allowing the power and the shaft displacement to be transmitted to the throttle shaft 25.

Secondly, the first and second throttle bodies 53*a* and 53*b* are fixed to the auxiliary machine unit 51 from both sides as shown in FIG. 8. The first and second throttle bodies 53*a* and 53*b* are fastened to the auxiliary machine unit 51 with bolt members 58. As a result, the throttle shaft 25 is rotatably inserted into holes formed in the first and second throttle bodies 53*a* and 53*b*.

In the next place, the throttle valve 23 is fastened to the throttle shaft 25 with screw members 24 as shown in FIG. 7. In addition, the injector 16 and the fuel pipe 29 are fixed to the throttle shaft 25. In this manner, the four throttle device 17 (multiple throttle device) shown in FIG. 4 is formed.

Since the instruments are fixed to the auxiliary machine unit 51 from both sides, it is not required that various components be fixed to the throttle body from many directions, and assembling work can be easily carried out.

Needless to say, the foregoing assembling process is only an example, and the process is not limited to the one mentioned above. The throttle device may be assembled through another process, such as a process in which the auxiliary machine unit 51 and the first and second throttle bodies 53*a* and 53*b* are previously assembled and then connected together.

When the four throttle device 17 is assembled according to the model of the engine 13, the throttle shaft 25 selected according to the engine 13 is fixed to the auxiliary machine unit 51, and then, the first and second throttle bodies 53*a* and 53*b* provided with a group of drums appropriate to the model of the engine 13 are fixed to the auxiliary machine unit 51. By so doing, the multiple throttle device having the above-described characteristics is assembled with respect to each model of the engine 13.

The invention is not limited to the foregoing embodiment, and may be modified in various ways without deviating from the gist thereof. For example, in the throttle-by-wire multiple throttle device of the embodiment, the sensor section and the drive section are placed between the drums of the second and third cylinders (between the intake passages). However, the sensor section and the drive section may be placed between the drums of the first and second cylinders or between the drums of the third and fourth cylinders as long as the sensor section and the drive section are positioned within the width of the throttle body. Although the embodiment applies the present invention to the four throttle device, the invention may be applied to a multiple throttle device used in a multi-cylinder engine, such as a three-cylinder engine, a five-cylinder engine and a six-cylinder engine. Needless to say, the engine may be a V-engine.

What is claimed is:

1. A multiple throttle device mounted on an engine having a plurality of cylinders arranged in line, comprising:

a throttle body having intake passages arranged corresponding to intake ports of cylinders of the engine;

throttle valves situated in the intake passages;

a throttle shaft that is rotatably disposed in the throttle body along the throttle valves arranged in line and supports the throttle valves so as to allow the throttle valves to be opened and closed;

a drive section that drives the throttle shaft, and a sensor section that detects the opening of the throttle valve, wherein the sensor section includes:

a shaft member formed to have a different axis from the throttle shaft, the shaft member is positioned within the width of the throttle body and displaced with the throttle shaft; and a throttle position sensor that is disposed in the shaft member and detects the opening of the throttle valves by the displacement of the shaft member;

the shaft member, the throttle position sensor and the drive section are disposed close to a center of the throttle body in a direction where the intake passages are arranged;

the shaft member, the throttle position sensor and the drive section are disposed between predetermined intake passages located in the center of the throttle body;

the shaft member and the throttle position sensor are disposed on one side in a radial direction of the intake passages across the throttle shaft in a zone between the predetermined intake passages; and the drive section is disposed on the other side in the radial direction of the intake passages across the throttle shaft.

2. The multiple throttle device according to claim 1, wherein:

the sensor section has a transmission mechanism for transmitting the displacement of the throttle shaft to the shaft member, and the transmission mechanism is disposed between the intake passages.

3. The multiple throttle device according to claim 1, wherein:

the shaft member, the throttle position sensor and the drive section are formed as one unit together with a portion of the throttle body, which occupies the space between the predetermined intake passages; and a portion of the throttle body, other than the portion located between the predetermined intake passages, is used as a component that is detachably fixed to the unit as a separated body from the unit.

4. The multiple throttle device according to claim 2, wherein:

the shaft member, the throttle position sensor and the drive section are formed as one unit together with a portion of the throttle body, which occupies the space between the predetermined intake passages; and a portion of the throttle body, other than the portion located between the predetermined intake passages, is used as a component that is detachably fixed to the unit as a separated body from the unit.

* * * * *